United States Patent [19]

Juillet

[11] Patent Number: 4,844,301

[45] Date of Patent: Jul. 4, 1989

[54] FLUID METERING AND DISPENSING DEVICE

[76] Inventor: Hubert Juillet, Mulhouse, France

[21] Appl. No.: 109,396

[22] Filed: Oct. 19, 1987

[51] Int. Cl.[4] ..... B67D 3/00

[52] U.S. Cl. ..... 222/509; 222/386.5; 222/389; 222/518

[58] Field of Search ..... 222/212, 386, 386.5, 222/387, 389, 510–511, 545, 559, 505, 509, 518; 239/323; 251/243, 319, 324, 400

[56] References Cited

U.S. PATENT DOCUMENTS

| | | | |
|---|---|---|---|
| 1,604,434 | 10/1926 | Welch et al. | 222/389 |
| 2,567,960 | 9/1951 | Myers et al. | 222/387 X |
| 2,652,177 | 9/1953 | Lagemann | 222/559 X |
| 3,162,336 | 12/1964 | Erickson | 222/386.5 X |

FOREIGN PATENT DOCUMENTS

| | | | |
|---|---|---|---|
| 636822 | 6/1983 | Switzerland | 222/387 |
| 472508 | 9/1937 | United Kingdom | 222/387 |
| 1168181 | 10/1969 | United Kingdom | 222/386.5 |

*Primary Examiner*—Michael S. Huppert

[57] ABSTRACT

A dispenser consisting of a cylindrical container made up of a molded plastic material, having a through-bore, a piston reciprocable in the container and defining two chambers respectively containing a product, such as tooth-paste, and a propellant gas, such as compressed air, and a valve having a valve body integral with the body of the container, so as to allow a user to extract a given quantity of product through the through-bore, as his needs arise. The valve comprises a needle moving in an opening extending transversely horizontally of the valve body. Its control member is an elbowed lever arm mounted ina cavity in the valve body on the opposite side of the through-bore.

24 Claims, 7 Drawing Sheets

FLUID METERING AND DISPENSING DEVICE

The present invention relates to a fluid dispenser and, more particularly, to a dispenser for products available on the market in semi-liquid form, as creams, as more or less thick pastes, as gels, and which are usually contained in deformable tubes, pots, boxes, etc.

A larger number of products of this kind are found in the cosmetics industry (beauty creams, shampoos, sun-tan milks, etc. . . ), in the pharmaceutical and hygienic industries (tooth-pastes, ointments, liquid soaps, etc. . . ) in the alimentary industry (mustards, mayonnaises, mashed tomatoes, sirup, etc. . . ), in manufacturing (putty, glues, etc. . . ) and in the upkeep services (waxes, waxings, etc. . . ).

The dispenser according to the present invention consists of a container of which the body is made of moldable material, preferably a synthetic resin, having a through-bore and including a product of a type as above disclosed and a propellant gas indirectly exerting a pressure on the product to expel the latter through a manually-controlled valve having a valve body which is integrally molded with the container body. This dispenser allows the user to extract a given quantity of product through the through-bore of the container, as his needs arise.

Known dispensers of this type also use a gas propellant which biases the the product either directly or indirectly through a piston or a resilient bag. These known dispensers are usually complex, very costly and of low reliability.

The dispenser according to the present invention is very simple, is made up of only a few parts; its manufacturing cost is relatively low and is technically very reliable.

The annexed drawing shows a schematic view of three embodiments of the invention.

Figure 1:
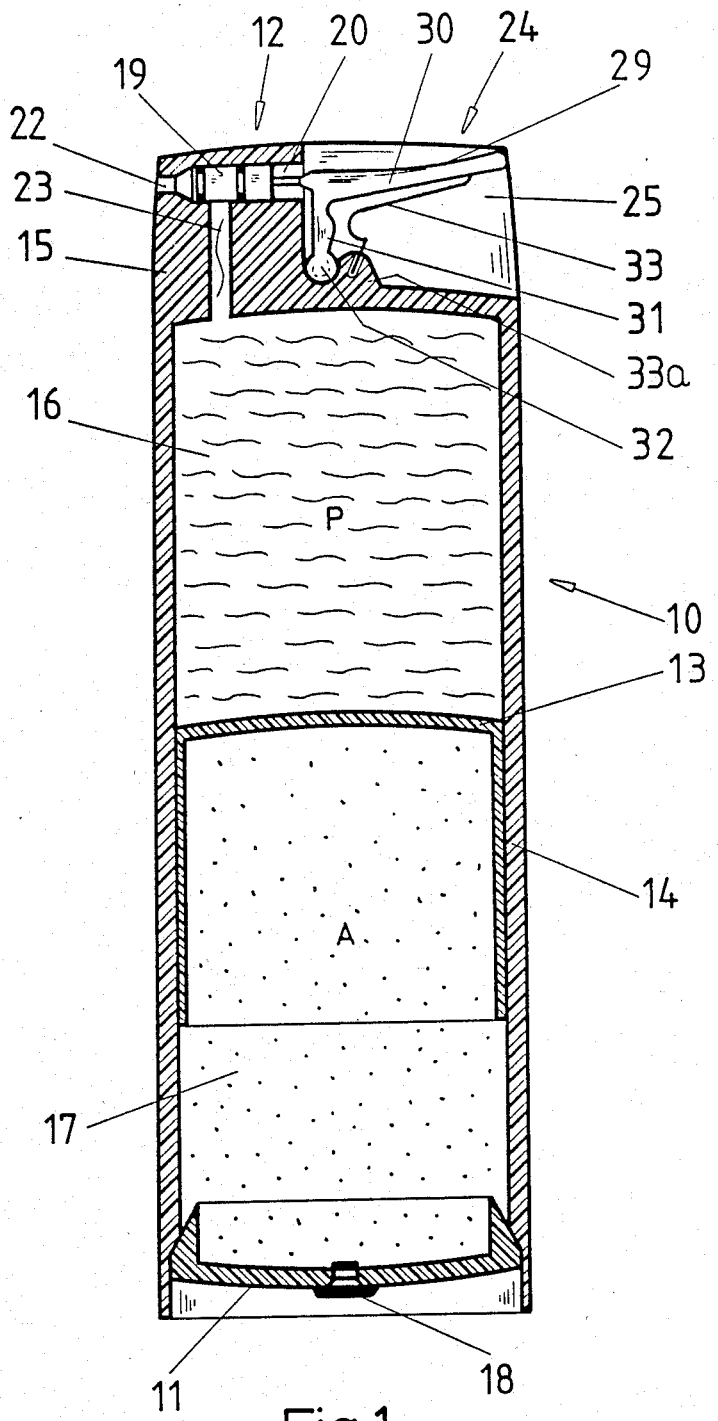
FIG. 1 is a vertical sectional view of a first embodiment.
Figure 2:
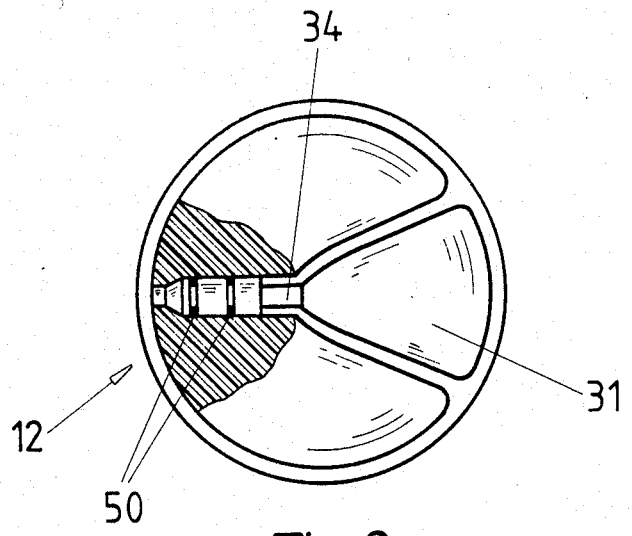
FIG. 2 is a partly-broken end view.
Figure 3:
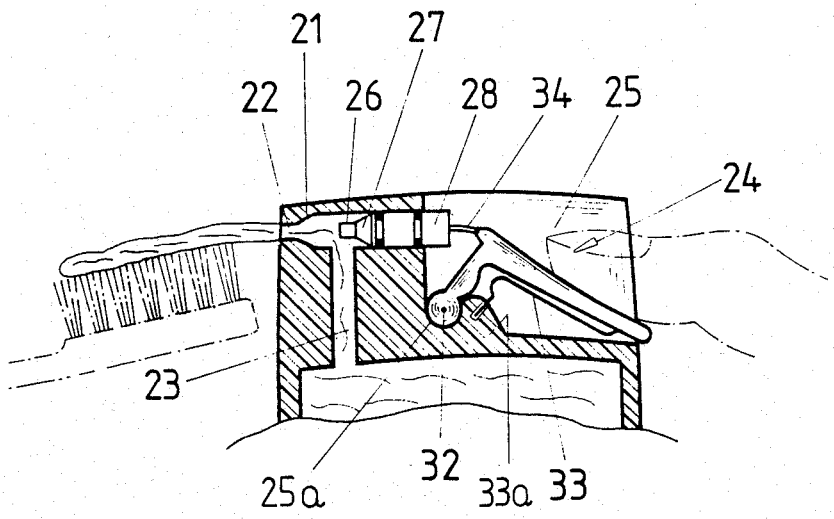
FIG. 3 is a fragmentary view of FIG. 1, showing the operation thereof.
Figure 4:
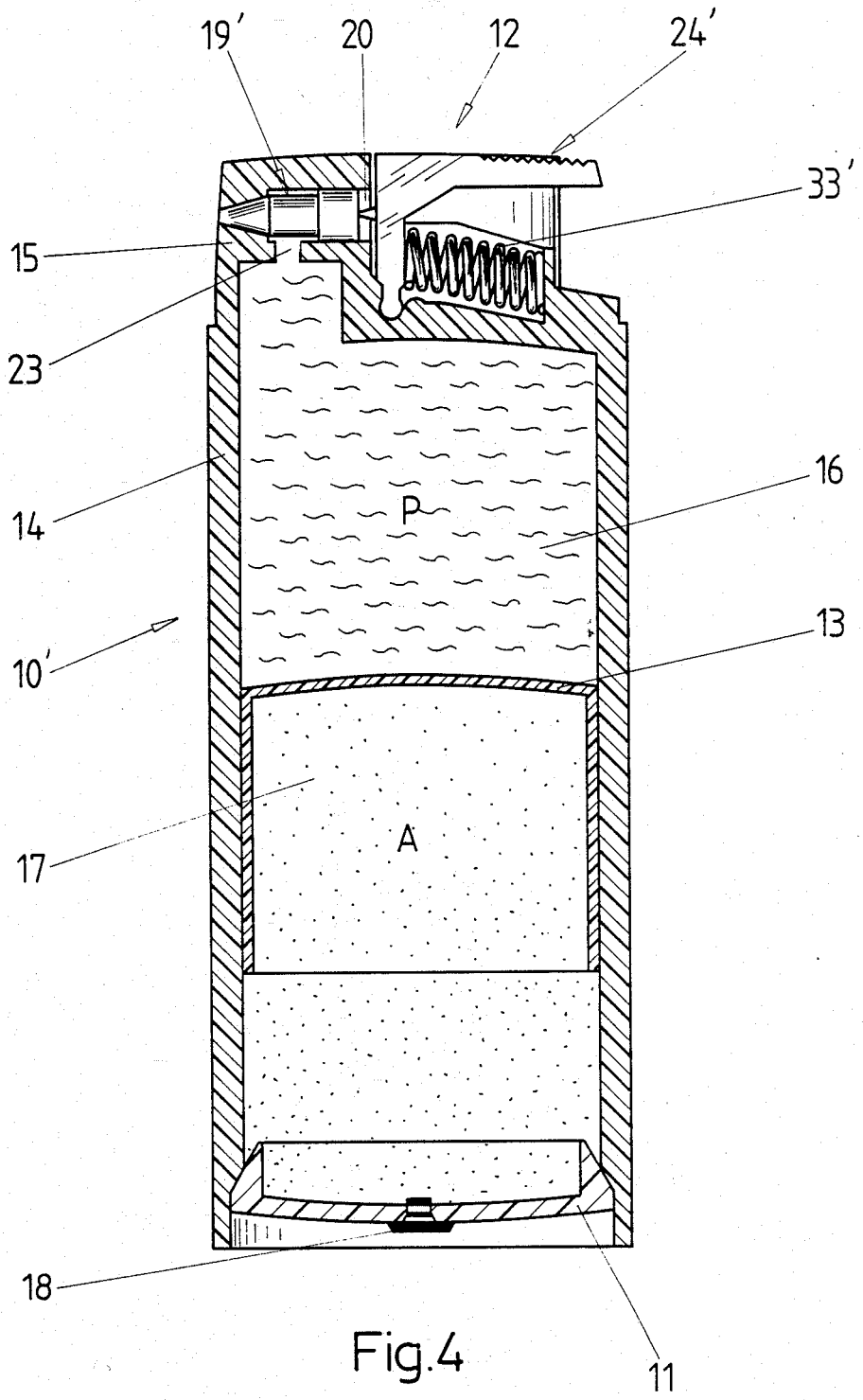
FIG. 4 is a view similar to that of FIG. 1 (but) showing a second embodiment.
Figure 5:
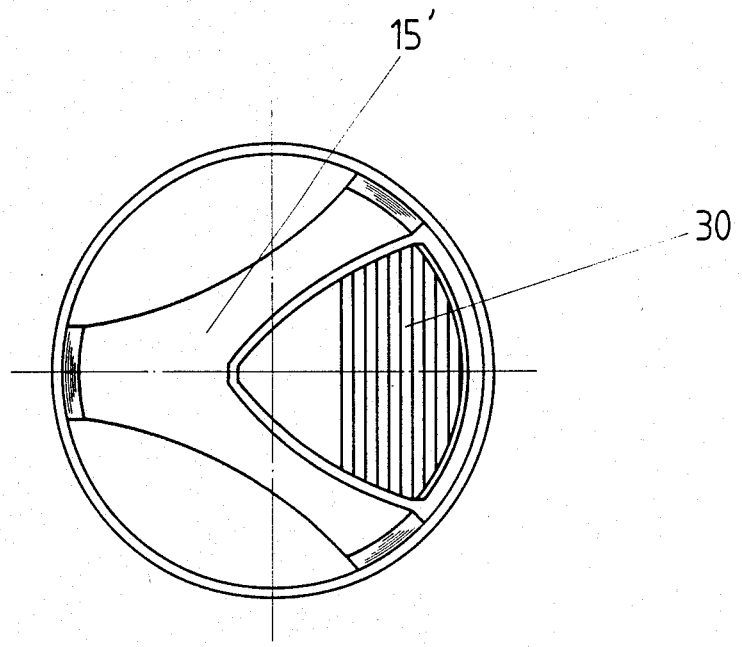
FIGS. 5 and 6 are views similar to FIGS. 2 and 3, but showing the second embodiment.
Figure 6:
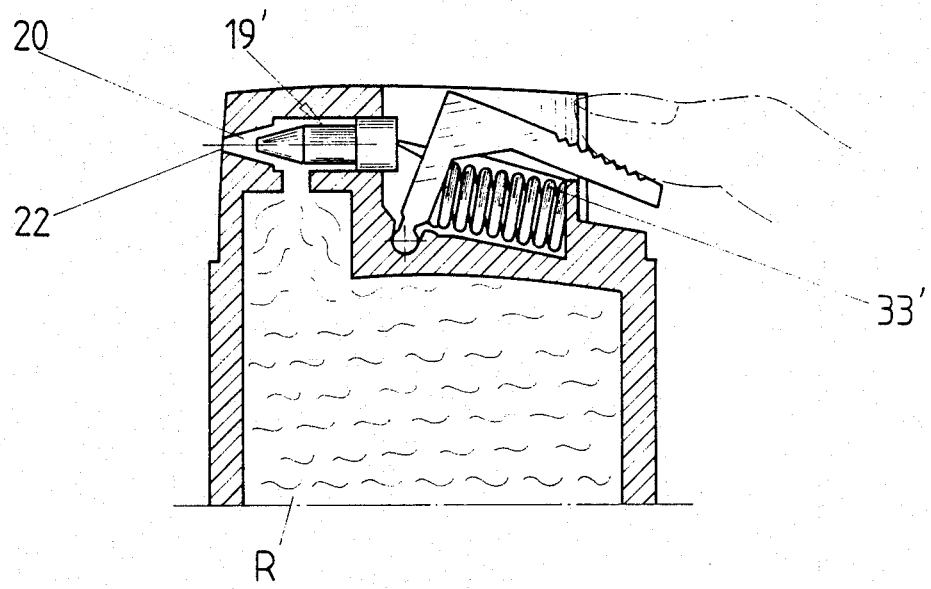
Figure 7:
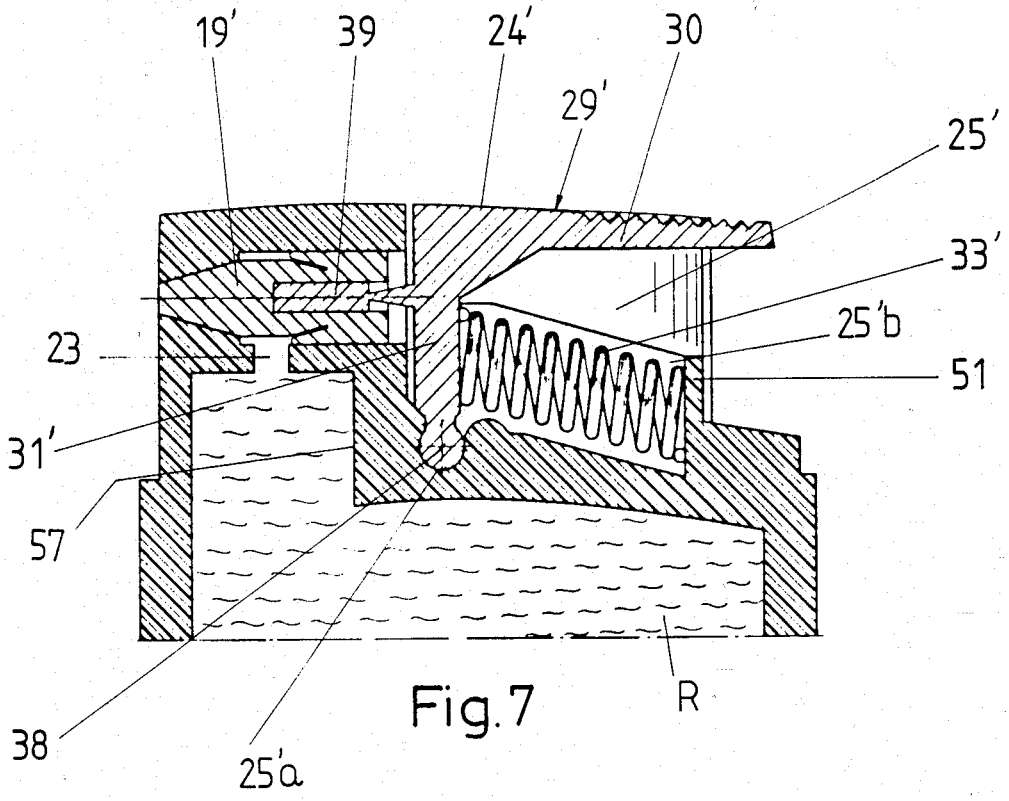
FIG. 7 is a view similar to that of FIG. 6 showing the valve in section.
Figure 8:
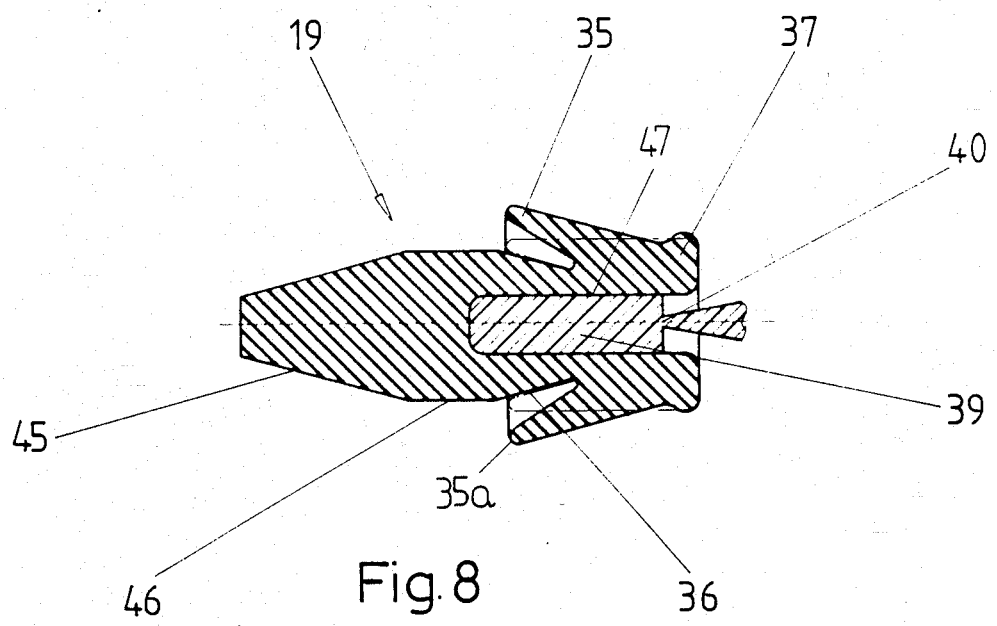
FIG. 8 is a sectional view of a portion of the valve.

The dispenser shown in FIGS. 1 to 3 consists of a cylindrical container 10, having a removable bottom end wall 11, a valve 12 and a piston 13.

These parts are made up from molded synthetic resin. The body 14 of the container 10 and the body 15 of the valve 12 are integrally molded.

Piston 13 defines, within container 10, two chambers 16 and 17 into which are respectively contained a paste product P, for example tooth-paste, and a propellant gas A, for example pressurized air.

Bottom end wall 11 comprises a through-bore sealingly closed by a rubber plug 18 for initial introduction of the propellant gas A.

The movable member of the valve 12 is a needle 19 sliding through a cylindrical channel 20 extending transversely of valve body 15.

The end of channel 20, proximate seat 21 merges with the aperture 22 of the dispenser.

A channel 23, in communication with chamber 16, opens into channel 20 transversely thereof.

The member for manually operating the needle 19 is a lever arm 24 mounted in a cavity 25 in the rear portion of valve body 15.

Needle 19 and lever arm 24 are integrally molded. Needle 19 includes a small cylindrical section 26, a small conical section 27 adapted to abut against seat 21 in the closed position of the valve 12, and a cylindrical section 28 diametrically, slightly less than equal to channel 22 to fit therein.

Lever arm 24 comprises an elbow 29 having two legs 31 and 30 vertically and horizontally extending respectively when valve 12 is closed. Elbow 29 is mounted for relative movement about the spherically-shaped lower end 32 of part 31. This spherical end 32 is snapped in a cavity 25a of corresponding dimensions made in the bottom of cavity 25.

Part 31 of arm 24 is generally triangular in plan view. It is laterally bounded by the walls defining cavity 25. A spring blade 33, embedded in valve body 15, at 33, biases upwardly the horizontal part 30 of lever arm 24.

Needle 19 and lever arm 24 are interconnected by a flexible tongue 34 projecting from elbow 29. The rotational axis 32 of arm 29 being downwardly positioned relative to the sliding axis of needle 19, lever arm 24 will downwardly rightwardly pivot pursuant to a downwardly-biasing force applied against part 30, which triggers opening of the valve 12. With cancellation of the biasing force, lever arm 24 comes back to its initial position under the bias of spring 33 and the needle comes back to its closed position.

When the valve 12 is opened, the chamber 16 is in communication with aperture 22 through channels 20 and 23 product P may flow through this orifice 22 under the bias of piston 13 being submitted to the pressure of gas A.

Needle 19 is sealed by two O-rings 50 mounted in two annular cavities made in two lengthwisely-spaced sections of the needle cylindrical part 28.

The second embodiment shown in FIGS. 4 to 8 comprises the same constituting members as in the first embodiment, i.e. a cylindrical container 10' having a removably-secured bottom end wall 11, a valve 12' and a piston 13. The body 14 of container 10' and the body 15' of valve 12' are integrally welded as one unit. The piston 13 divides the inside of container 10' in two chambers 16 and 17 containing a fluid, such as a sun tan lotion R, and a propellant gas A, for example compressed air, respectively. As in the first embodiment, valve 12' consists of a needle 19' a manually-controlled lever arm 24' and a biasing spring 33'.

In this embodiment, the body 15' of valve 12' is Y-shaped in plan view. Channel 20 extends transversely of the base leg of this Y-shaped body, while the two diverging legs thereof define the lateral sides of the cavity 25' into which the lever arm 24' is mounted.

The needle 19' is made of a material having some resiliency, such as rubber or the like elastomer, and consisting of a conical portion 46 and of an annular section 26, and of a circular sealing lip 35, with a face 36 formed by an extension of section 46 in register with lip 35. This lip 35 is integrally molded with needle 19'.

When the needle 19' is engaged in channel 20, this lip 35 is resiliently deformed and comes to abut against a conical face 36 formed by the body of the needle 19 opposite ring 35.

An annular thickening 37 at the rear of needle 19' is also resiliently deformed and exerts a biasing force against the inner wall of body 15' defined by channel 20.

As in the first embodiment, the lever arm 24', molded of plastic, comprises an arm 24' having a vertical part 31'and a horizontal part 30, of generally triangular shape. This arm 24' is articulated around a horizontal axis defined by the spherical lower end 38 of vertical part 31'.

This lower end 38 is snapped in a cavity 25'*a* of corresponding dimensions made in the bottom of cavity 25'.

A rod 39 integrally molded with the vertical part 31' of arm 24' interconnects the needle 19' and the lever arm 24' by being inserted with a press-fit in a cavity 47 of corresponding dimensions made in needle 19'. This rod 39 includes a narrowed end section 40 constituting a flexible link between the needle 19' and the arm 24'. This rod 39 also constitutes a core for the needle 19' which improves the efficiency and reliability of the seal of lip 35.

The biasing spring 33' consists of a compression coil spring mounted in a cavity 25'*b* made at the rear of the pivotal axis of arm 24' at the bottom of cavity 25' under the horizontal part 30. It abuts against the vertical part 31 of the arm 24, at one end and against a rear wall 51 made integral to wall 14 and substantially parallel to leg 31' when valve 12' is closed and partially closing the near end of cavity 25', so as to allow pivotal play for leg 30 during actuation of lever 24'.

Figure 9:
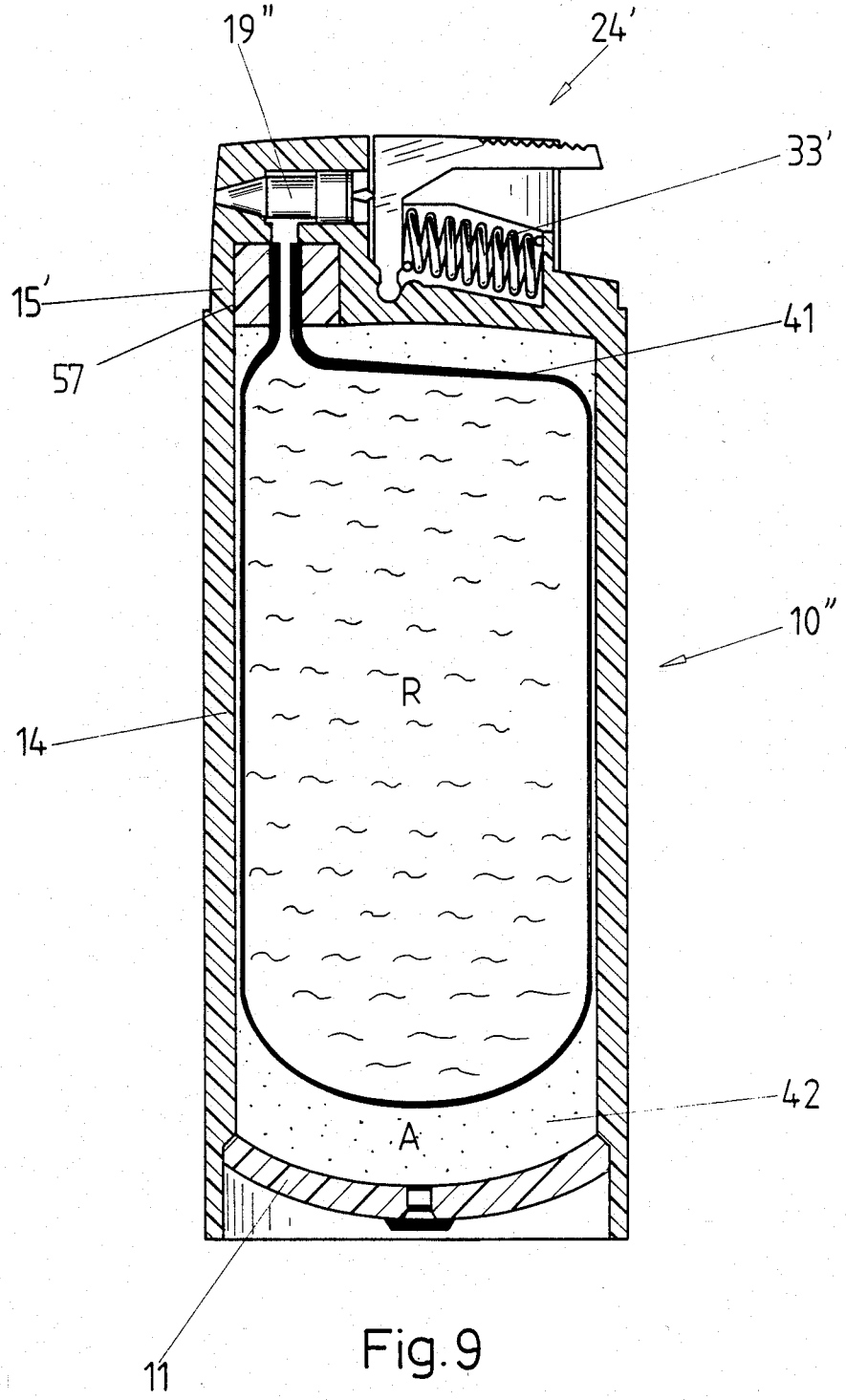
FIG. 9 is a view similar to that of FIG. 1 but of a third embodiment.
Figure 10:
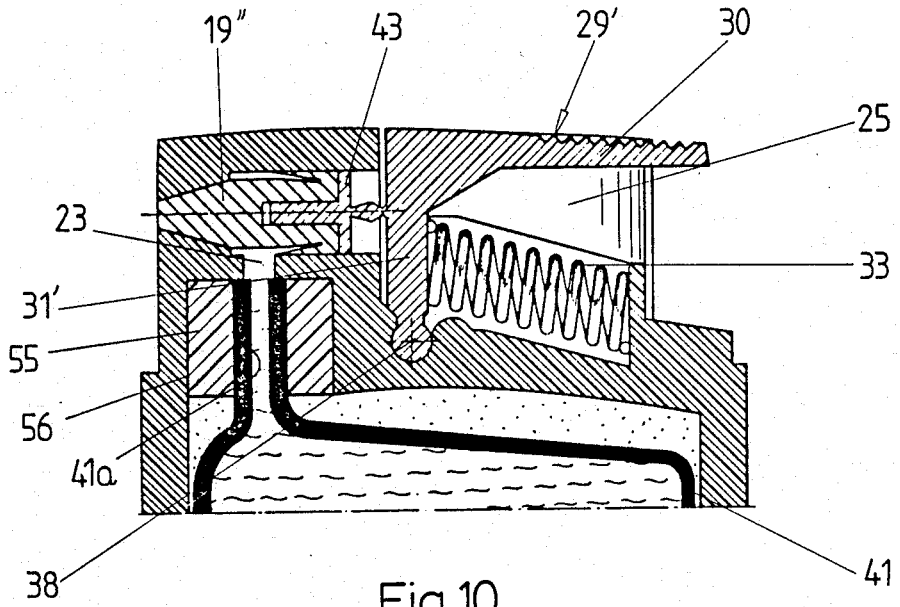
FIGS. 10 and 11 are views similar to those of FIGS. 7 and 8 but showing the third embodiment.
Figure 11:
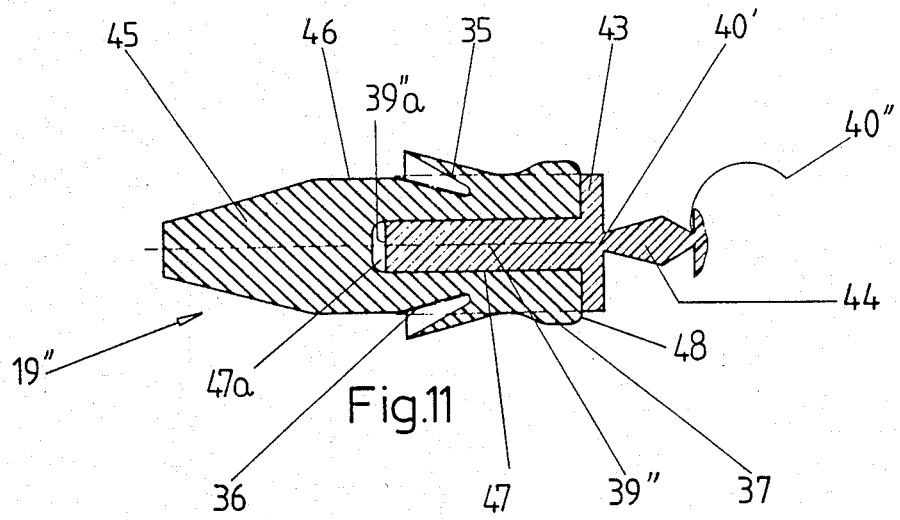

The third embodiment shown in FIGS. 9 to 11 against shows a container 10'', which comprises the same constituting members as in the second embodiments, except for piston 13, which is replaced by an elastic bag 41 containing the product R. The propellant gas A fills up the cavity 42 defined between the bag 41 and the wall 14 of the container 10''.

This third embodiment can be distinguished from the second one in that the rod 39'' includes an enlarged (intermediate) collar 43, abutting against the rear wall 48 of needle 19'' which is used as a rigid guiding member for the needle 19', and two (spaced) narrowed sections 40', 40'', instead of a single one, which form two flexible joints at each end of a crank-arm 44. Crank arm 44 is integrally mounted to leg 31'. Collar 43 ensures that a gap 47*a* remains in cavity 47 between the inner end 39''*a* of rod 39'' and the inner end of cavity 47. An annular plug 55 having a central channel 56 is also mounted in register with channel 23, engaging by friction fit a cylindrical cavity 57 (see also FIG. 7) thereabout. The channel 56 receives the mouth 41*a* of bag 41, so as to retain frictionally this mouth in register with channel 23.

Obviously, the invention is not limited by what is shown in the drawings nor by what is hereinabove disclosed.

More particularly, (other) embodiments could be envisioned, using some of the members present in the above-disclosed embodiments in dispensers in which the propellant would act directly on the product to be dispensed, as for example, in conventional air-sprays.

I claim:

1. A dispenser of fluid products, chosen from the group comprising liquids, semi-liquids, pastes, consisting of a container, defining an aperture and containing a fluid product and a propellant gas exerting a given pressure against the product, and of a valve allowing the user to dispense a given quantity of product through said aperture, wherein said container defines a body and said valve defines a body, these two bodies being integrally molded, and wherein said valve comprises a needle slidable in a first channel extending transversely of the body of the valve, one of the ends of said first channel merging with said aperture of said container, a manual-control member mounted in a main cavity made in the body of the valve, on the opposite side of said aperture, a second channel transversely opening into said first channel, a return biasing means for said needle, sealing means to prevent said product from flowing between the needle and the wall of surrounding said first channel, in such a way that the needle is moved while said control member is manually operated against the bias of said biasing means from a first position in which it closes said aperture to a second position in which said aperture is in communication with said product in said container through said first and second channels, and automatically returns to its first position under the bias of said return biasing means when said manual operation of said control member stops.

2. A dispenser as in claim 1, wherein the axis of said first channel is substantially perpendicular to said second channel.

3. A dispenser as in claim 1, wherein said control member is a lever arm connected to said needle through the other end of said first channel.

4. A dispenser as in claim 3, wherein said lever arm comprises an elbow having two substantially-orthogonal integral parts defining vertical and horizontal legs.

5. A dispenser as in claim 4, wherein the elbow of lever arm pivots around an axis positioned below the sliding axis of said needle, whereby in order to bring the needle in opened position, a downwardly-directed biasing force has to be exerted on the horizontal part of the elbow to pivot the lever arm downwardly.

6. A dispenser as in claim 5, wherein said pivotal axis of said lever arm consists of a lower free end of spherical shape of the vertical part of said elbow, this spherical end being snapped in a semi-circular cavity of corresponding dimensions made in the bottom of said main cavity.

7. A dispenser as in claim 4, wherein the horizontal part of the elbow is generally triangular in plan view.

8. A dispenser as in claim 3, wherein said needle and said lever arm are interconnected through a flexible link.

9. A dispenser as in claim 8, wherein said needle, said lever arm and said link are integrally molded.

10. A dispenser as in claim 4, wherein said biasing means biases the horizontal part of the elbow.

11. A dispenser as in claim 1, wherein said sealing means includes O-rings surrounding said needle.

12. A dispenser as in claim 1, wherein the end of said needle which closes the valve is flush with the edge of said aperture when in its closed position.

13. A dispenser as in claim 1, wherein the body of the valve is Y-shaped in plan view with said first channel extending transversely of the base leg thereof.

14. A dispenser as in claim 3, wherein said needle is made of a material having some resiliency and chosen from the group comprising rubber.

15. A dispenser as in claim 14, wherein said sealing means includes at least one lip integral with said needle and frontwardly extending relative to the latter.

16. A dispenser as in claim 15, wherein the needle defines a body including a section of decreasing thickness facing said lip and terminating at the root of said lip relative to the latter.

17. A dispenser as in claim 14, wherein the needle includes an annular thickened section at its rearward end.

18. A dispenser as in claim 14, wherein said needle and said lever arm are interconnected by at least one articulation.

19. A dispenser as in claim 14, wherein said needle and said lever arm are made of two different parts.

20. A dispenser as in claim 19, wherein said needle and said lever arm are connected one to the other by a rod which is integral with said lever arm and which is press-fitted in an axial cavity made in the body of the needle.

21. A dispenser as in claim 20, wherein the connection of the needle to the lever arm comprises two articulations consisting of two narrower sections of the rod defining a crank-arm.

22. A dispenser as in claim 20, wherein said rod includes a guiding collar for guiding the needle.

23. A dispenser as in claim 4, wherein said biasing means is a compression coil spring mounted in a recess made in said main cavity under said lever arm.

24. A dispenser as in claim 1, wherein said first channel defines a conical part constituting the seat of a corresponding conical part of said needle which merges with said aperture of the container at its diametrically-reduced end.

* * * * *